US007254911B2

(12) United States Patent
Lin

(10) Patent No.: US 7,254,911 B2
(45) Date of Patent: Aug. 14, 2007

(54) MULTI-FUNCTIONAL CALENDAR STRUCTURE

(76) Inventor: Li Jung Lin, 4 Fl., No.8, Alley 26, Lane 215, Tianxiang Rd., Changhua City (TW)

( * ) Notice: Subject to any disclaimer, the term of this patent is extended or adjusted under 35 U.S.C. 154(b) by 322 days.

(21) Appl. No.: 11/086,375

(22) Filed: Mar. 23, 2005

(65) Prior Publication Data

US 2006/0215496 A1 Sep. 28, 2006

(51) Int. Cl.
*G09D 3/04* (2006.01)
*G09F 7/12* (2006.01)
*B42D 5/04* (2006.01)

(52) U.S. Cl. ..... 40/110; 40/594; 283/2; 368/28

(58) Field of Classification Search ..... 368/10, 368/28–30, 223, 278; 40/107, 110, 119–121, 40/595; 283/2–4; D19/20, 21
See application file for complete search history.

(56) References Cited

U.S. PATENT DOCUMENTS 3,290,812 A * 12/1966 Hunkins ..... 40/107
3,783,541 A * 1/1974 Bowerman ..... 40/121
3,911,606 A * 10/1975 Hunkins ..... 40/110
4,858,350 A * 8/1989 Malarchik ..... 40/119
6,217,076 B1 * 4/2001 Howard et al. ..... 283/2
7,004,505 B2 * 2/2006 Perelman ..... 283/2
7,134,228 B2 * 11/2006 Sassenberg ..... 40/122
2005/0160636 A1 * 7/2005 Nein et al. ..... 40/119

* cited by examiner

*Primary Examiner*—Vit Miska
*Assistant Examiner*—Jeanne-Marguerite Goodwin
(74) *Attorney, Agent, or Firm*—Troxell Law Office, PLLC

(57) ABSTRACT

A multi-functional calendar structure includes a calendar made up of a set of upper and lower layers wherein the upper layer has week elements, day elements, and month elements respectively marked at the front face thereon, and a plurality of empty elements for recording important occasions or favorable/forbidden events in the month sequentially arranged at the bottom of the front face thereon. Each of the day and empty elements is provided with a set of top and bottom dotted tearing lines, a set of transversely U-shaped left and right cut areas disposed at both adjacent edges of the top/bottom dotted tearing lines thereof, an oblique cut opening defining the lower section of the left cut area thereof, and an adhesive portion properly coated at the reverse face thereon and limited within the left/right cut areas thereof. The lower layer is also provided with identical day and empty elements in corresponding positions relative to that of the upper layer thereof. Therefore, the day/empty elements with memo recorded thereon can be easily detached from the upper layer to serve as notes for easy carry outside, while identical copies of the memo can be left on the corresponding day/empty elements of the lower layer for further reference by other people. Besides, via the adhesive portions thereof, the note can be easily attached to an obvious position in cars or the offices as a reminder, efficiently providing a multi-functional calendar thereby.

2 Claims, 4 Drawing Sheets

MULTI-FUNCTIONAL CALENDAR STRUCTURE

BACKGROUND OF THE INVENTION

The present invention is related to a multi-functional calendar structure, including a calendar made up of a set of upper and lower layers wherein day elements of the upper layer are equipped with top/bottom dotted tearing lines and left/right cut areas respectively so that the day elements with daily schedule/memo recorded thereon can be easily detached from the upper layer to serve as notes for easy carry outside, while identical copies of the daily schedule/memo can be left on the corresponding day elements of the lower layer thereof for further reference by other people, efficiently providing a multi-functional calendar thereby.

A normal calendar on the market usually has day elements, week elements, and month elements directly printed onto a sheet of paper; whereby, in practical use, daily schedule or memo directly written beside the day elements thereof as reminder must be recorded again in another notebook for carry outsides, which is only unchangeably dull but also quite inconvenient in use.

SUMMARY OF THE PRESENT INVENTION

It is, therefore, the primary purpose of the present invention to provide a multi-functional calendar structure, including a calendar made up of a set of upper and lower layers wherein day elements of the upper layer are equipped with top/bottom dotted tearing lines and left/right cut areas respectively so that the day elements with memo recorded thereon can be easily detached from the upper layer to serve as notes for easy carry outside without the memo being written again in another notebook, providing a more convenient and handy calendar structure thereby.

It is, therefore, the second purpose of the present invention to provide a multi-functional calendar structure wherein, after the day elements with daily schedule/memo recorded thereon are detached from the upper layer via the top/bottom dotted tearing lines and the left/right cut areas thereof, identical copies of the daily schedule/memo are left on the corresponding day elements of the lower layer for further reference by other people.

It is, therefore, the third purpose of the present invention to provide a multi-functional calendar structure wherein, via an adhesive portion coated at the reverse side of the detached day element, the note obtained thereby can be easily attached to an obvious position in cars or the offices as a reminder, efficiently providing a multi-functional calendar in practical use.

DETAILED DESCRIPTION OF THE PREFERRED EMBODIMENTS

Figure 1:
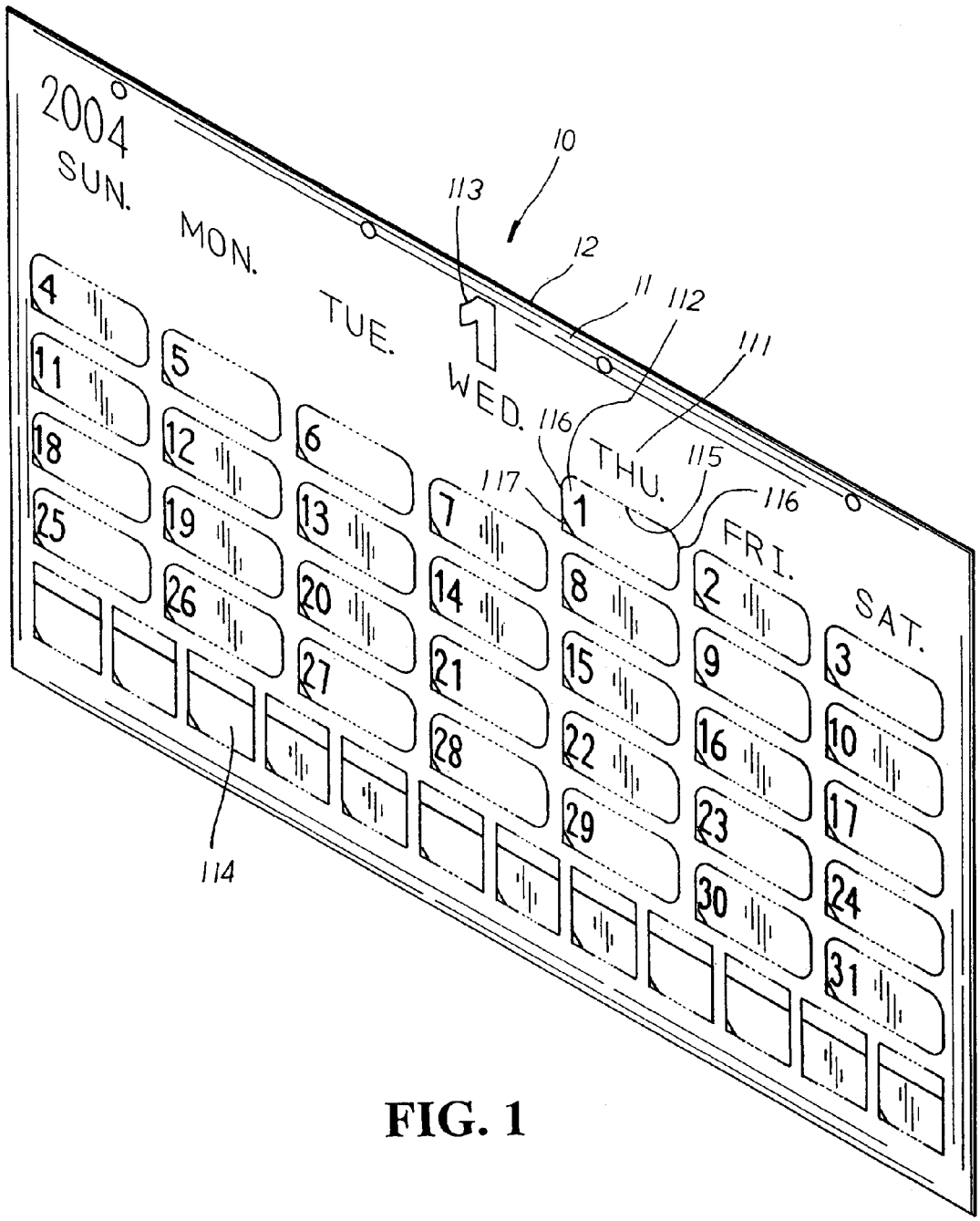
FIG. 1 is an exploded perspective view of the present invention.
Figure 2:
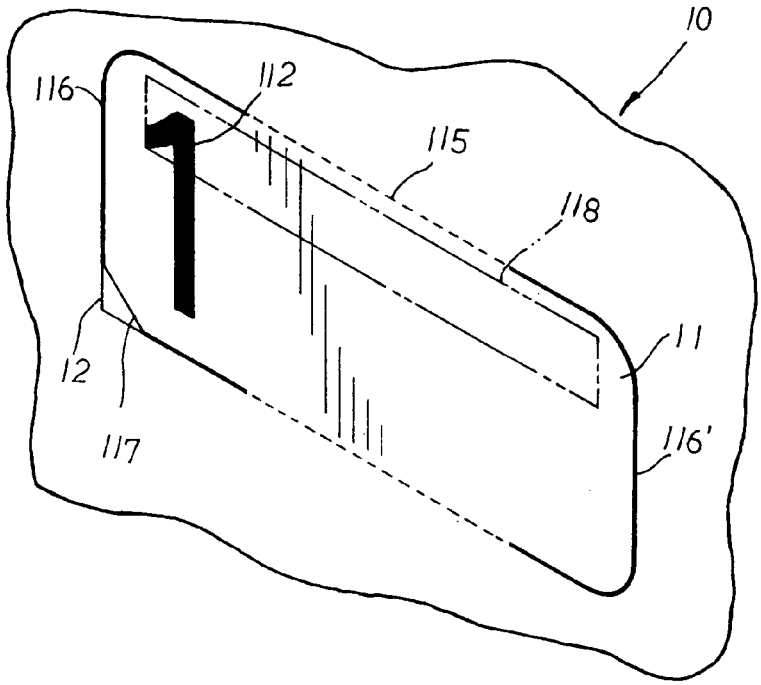
FIG. 2 is a partially enlarged view of the present invention.

Please refer to FIGS. 1 to 2 inclusive. The present invention is related to a multi-functional calendar structure, including a calendar 10 made up of a set of upper and lower layers 11, 12 wherein the upper layer 11 has week elements 111, day elements 112, and month elements 113 respectively marked at the front face thereon, and a plurality of empty elements 114 for recording important occasions or favorable/forbidden events in the month sequentially arranged at the bottom of the front face thereon. Each of the day elements 112 and the empty elements 114 is provided with a set of top and bottom dotted tearing lines 115 defining both upper and lower edges thereon, and at both adjacent edges of the top/bottom dotted tearing lines 115 is disposed a set of transversely U-shaped left and right cut areas 116, 116' with an oblique cut opening 117 defining the lower section of the left cut area 116 thereof. Besides, each of the day and empty elements 112, 114 has an adhesive portion 118 properly coated at the edge of the reverse face thereon and limited within the left/right cut areas 116, 116' thereof. The lower layer 12 is also provided with identical day elements 121 and empty elements in corresponding positions to precisely match with the day elements 112 and the empty elements 114 of the upper layer 11 thereof respectively.

Figure 3:
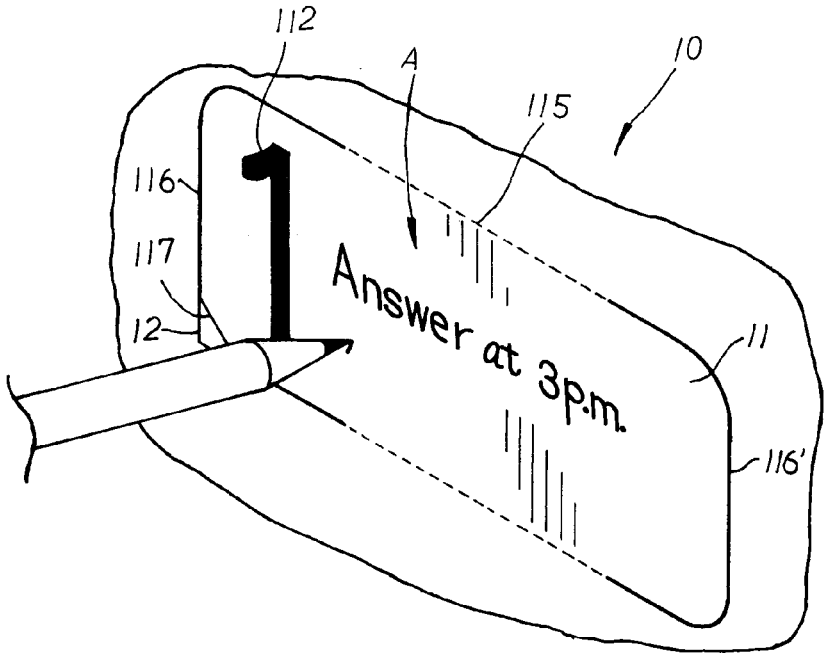
FIG. 3 is a diagram showing a memo recorded onto the present invention.
Figure 4:
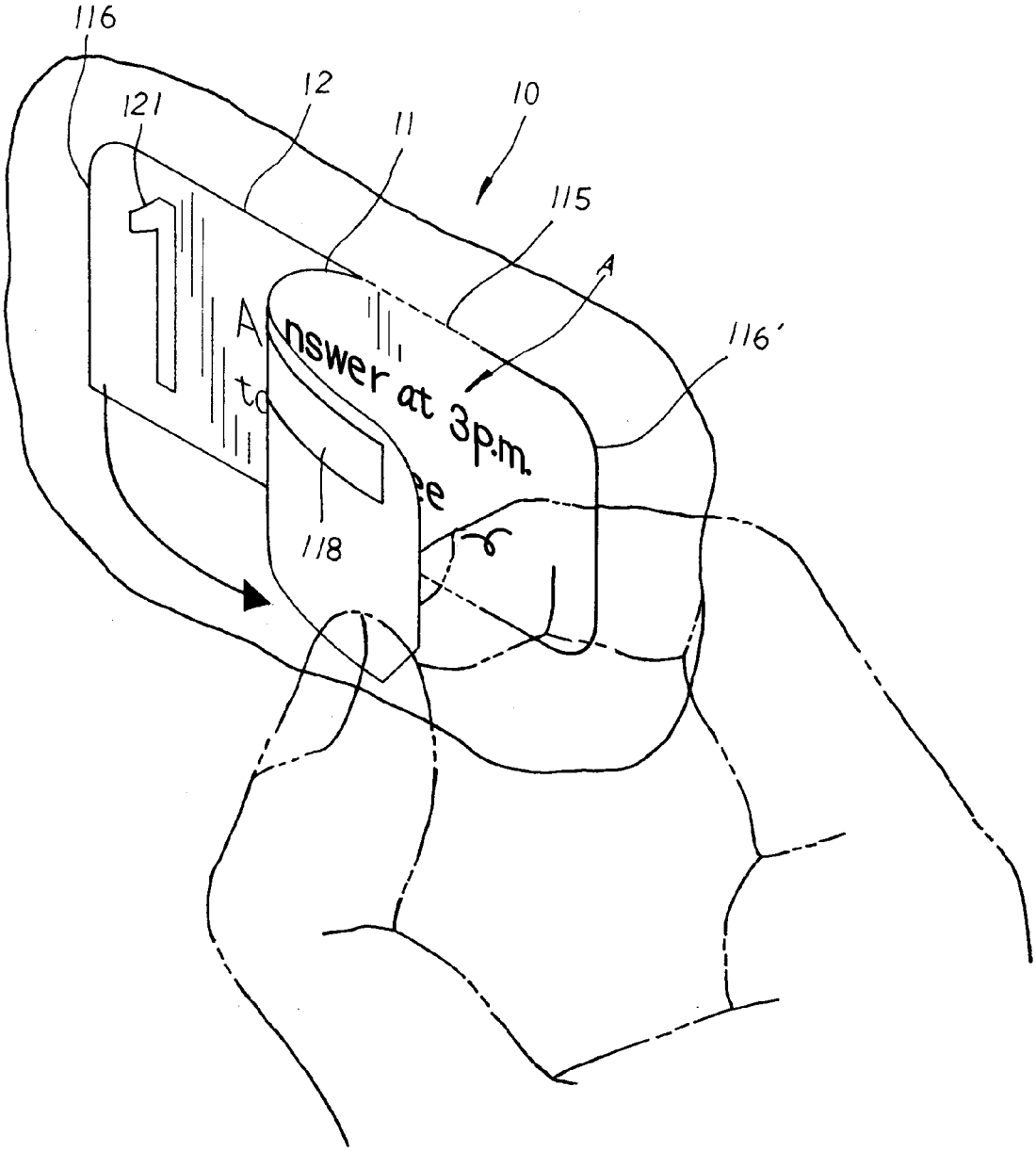
FIG. 4 is a diagram showing the tearing-off operation of the present invention.
Figure 5:
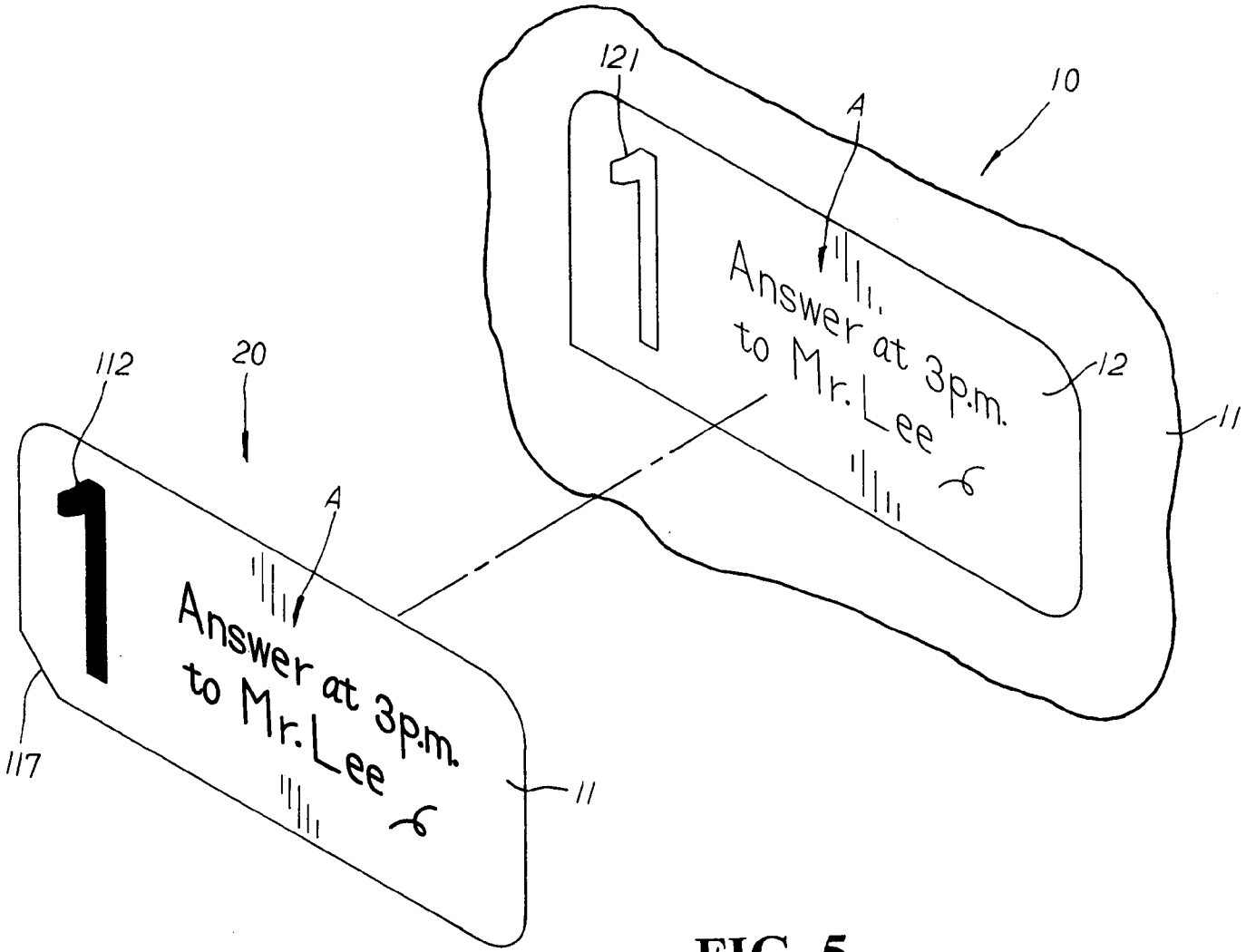
FIG. 5 is a diagram showing a day element of the present invention torn and detached to serve as a note in operation thereof.

Please refer to FIGS. 3 to 5 inclusive. In practical use, daily schedule or memo A is written onto the upper layer 11 at the space of an identified day element 112 defined by the left/right cut areas 116, 116' and the top/bottom dotted tearing lines 15 therein as shown in FIG. 3. Meanwhile, the memo A recorded on the upper layer 11 will copy onto the space of the corresponding day element 121 disposed at the lower layer 12 thereof. Then, the oblique cut opening 117 can be guided along the left cut area 116 to tear off the day element 112 with the memo A recorded thereon along the top/bottom dotted tearing lines 115 till reaching the right cut area 116' (as shown in FIG. 4) so as to detach the day element 115 completely from the upper layer 11 to serve as a note 20 for handy and easy carry outside without the memo A being recorded again in another notebook. Besides, an identical copy of the memo A is left on the corresponding day element 121 of the lower layer 12 for further reference by other people as shown in FIG. 5. Via the adhesive portion 118 thereof, the note 20 can be easily attached to an obvious position in cars or the offices as a reminder, efficiently providing a multi-functional calendar 10 thereby.

What is claimed is:

1. A multi-functional calendar structure, including a calendar made up of a set of upper and lower layers wherein the upper layer has week elements, day elements, and month elements respectively marked at a front face thereon, and a plurality of empty elements for recording important occasions or favorable/forbidden events in the month sequentially arranged at a bottom of a front face thereon;

each of the day and empty elements being provided with a set of top and bottom dotted tearing lines defining both upper and lower edges thereon, a set of left and right cut areas disposed at both adjacent edges of the top and bottom dotted tearing lines thereof, an oblique cut opening disposed at a lower section of the left cut area thereof, and an adhesive portion properly coated at an edge of a reverse face thereon and limited within the left and right cut areas thereof;

the lower layer being provided with identical day elements and empty elements in corresponding positions relative to that of the upper layer thereof;

therefore, daily schedule or memo can be written onto the upper layer at a space of an identified day element defined by the left and right cut areas and the top and bottom dotted tearing lines therein before the oblique cut opening is guided along the left cut area to tear off the day element with the daily schedule or memo recorded thereon along the top and bottom dotted tearing lines till reaching the right cut area to provide a note for handy and easy carry outside without the daily schedule or memo being recorded again in another notebook;

besides, an identical copy of the daily schedule or memo is left on the corresponding day element of the lower layer for further reference by other people, and via the adhesive portion thereof, the note can be easily attached to an obvious position in cars or the offices as a reminder, efficiently providing a multi-functional calendar thereby.

2. The multi-functional calendar structure as claimed in claim 1 wherein the left and right cut areas defining both left/right sides of each day element thereof are oppositely arranged in transverse U-shaped forms.

* * * * *